US010822189B2

(12) United States Patent
Malmqvist et al.

(10) Patent No.: US 10,822,189 B2
(45) Date of Patent: Nov. 3, 2020

(54) METHOD OF THREADING A FIBROUS WEB AND A REEL-UP FOR CARRYING OUT THE METHOD

(71) Applicant: VALMET AKTIEBOLAG, Sundsvall (SE)

(72) Inventors: Per-Olof Malmqvist, Karlstad (SE); Lars Gustafsson, Skattkaerr (SE); Claes Thelander, Karlstad (SE); Tomas Carlsson, Hammaroe (SE)

(73) Assignee: VALMET AKTIEBOLAG, Sundsvall (SE)

( * ) Notice: Subject to any disclaimer, the term of this patent is extended or adjusted under 35 U.S.C. 154(b) by 0 days.

(21) Appl. No.: 16/495,338

(22) PCT Filed: Mar. 8, 2018

(86) PCT No.: PCT/EP2018/055777

§ 371 (c)(1),
(2) Date: Sep. 18, 2019

(87) PCT Pub. No.: WO2018/177716

PCT Pub. Date: Oct. 4, 2018

(65) Prior Publication Data

US 2020/0148494 A1 May 14, 2020

(30) Foreign Application Priority Data

Mar. 30, 2017 (SE) ..... 1750384

(51) Int. Cl.
*B65H 18/22* (2006.01)
*B65H 19/26* (2006.01)
(Continued)

(52) U.S. Cl.
CPC ..... *B65H 18/22* (2013.01); *B65H 19/265* (2013.01); *B65H 19/283* (2013.01);
(Continued)

(58) Field of Classification Search
USPC ..... 162/118
See application file for complete search history.

(56) References Cited

U.S. PATENT DOCUMENTS 4,320,582 A 3/1982 Klippstein et al.
5,507,917 A 4/1996 Didier et al.
(Continued)

FOREIGN PATENT DOCUMENTS

CN 1390759 A 1/2003
WO WO 2000/71453 A1 11/2000

OTHER PUBLICATIONS

International Searching Authority, International Search Report and Written Opinion for International Application No. PCT/EP2018/055777, dated Jul. 9, 2018, 11 pages, European Patent Office, The Netherlands.

(Continued)

*Primary Examiner* — Jacob T Minskey
(74) *Attorney, Agent, or Firm* — Alston & Bird LLP

(57) ABSTRACT

The invention relates to a method of threading a fibrous web (W) onto a circular cylindrical object (3, 19) in a reel-up (2) for a paper-making machine (1). The reel-up (2) comprises an endless flexible belt (6) mounted for rotation along a predetermined path of travel. The endless flexible belt (6) is positioned adjacent the circular cylindrical object (3, 19) during winding and the fibrous web (W) residing on the outside surface (8) to engage the circular cylindrical object (3, 19) during winding such that the endless flexible belt (6) is deflected from the predetermined path of travel. When a fibrous web (W) is to be threaded onto the circular cylindrical object (3, 19), the circular cylindrical object (3, 19) is placed at a distance from the endless flexible belt (6) such that the endless flexible belt (6) is no longer deflected from the its path of travel. A narrow tail (17) is cut from a fibrous web (W) that is to be threaded and the narrow tail (17) is
(Continued)

advanced on the outside surface (8) of the endless flexible belt (6). The circular cylindrical object (3, 19) is moved towards the endless flexible belt (6) such that the circular cylindrical object (3, 19) comes into contact with the narrow tail (17) and an adhesive substance is applied to the to the narrow tail (17) such that the narrow tail (17) will adhere to the circular cylindrical object and starts to be wound on the circular cylindrical object (3, 19), whereafter the narrow tail (17) is widened. The invention also relates to a reel-up (2) capable of carrying out the method.

13 Claims, 8 Drawing Sheets

(51) Int. Cl.
*B65H 19/28* (2006.01)
*D21G 9/00* (2006.01)

(52) U.S. Cl.
CPC ..... *B65H 19/286* (2013.01); *D21G 9/0063* (2013.01); *B65H 2301/41424* (2013.01); *B65H 2301/522* (2013.01); *B65H 2801/84* (2013.01)

(56) References Cited

U.S. PATENT DOCUMENTS

| | | | | |
|---|---|---|---|---|
| 5,782,426 | A * | 7/1998 | Kinnunen ..... | B65H 18/22 242/526.3 |
| 5,910,918 | A | 6/1999 | Hirano | |
| 6,030,500 | A | 2/2000 | Haraldsson et al. | |
| 6,695,245 | B1 | 2/2004 | Schultz et al. | |
| 6,698,681 | B1 | 3/2004 | Guy et al. | |
| 8,438,752 | B2 | 5/2013 | Mennucci et al. | |
| 9,511,968 | B2 | 12/2016 | Malmqvist | |
| 2003/0226279 | A1 | 12/2003 | Klerelid et al. | |
| 2006/0289692 | A1 | 12/2006 | Horneck et al. | |
| 2016/0185548 | A1 | 6/2016 | Malmqvist | |
| 2016/0251187 | A1 | 9/2016 | Malmqvist et al. | |

OTHER PUBLICATIONS

Chinese State Intellectual Property Office, Chinese Examination Report for Application No. 20188002188.3, dated Jun. 3, 2020, (7 pages), Beijing, China.

* cited by examiner

METHOD OF THREADING A FIBROUS WEB AND A REEL-UP FOR CARRYING OUT THE METHOD

CROSS REFERENCE TO RELATED APPLICATIONS

This application is a National Stage Application, filed under 35 U.S.C. 371, of International Application No. PCT/EP2018/055777, filed Mar. 8, 2018, which international application claims priority to and the benefit of Swedish Application No. 1750384-8, filed Mar. 30, 2017; the contents of both of which as are hereby incorporated by reference in their entirety.

BACKGROUND

Related Field

The invention relates to a method of threading a fibrous web. The invention also relates to a reel-up for carrying out the inventive method.

Description of Related Art

In a paper making machine, a reel-up is used to wind the paper web that has been manufactured into a parent roll that can subsequently be sent to further processing. U.S. Pat. No. 5,901,918 discloses a reel-up that comprises a reel spool and an endless flexible member that may be an air permeable endless flexible belt. The endless flexible member is mounted for rotation along a predetermined path of travel and it is positioned adjacent to the reel spool. A deflection sensor measures deflection of the flexible member from the predetermined path of travel by an amount relative to the amount of paper material wound on the reel spool. An actuator is arranged for positioning the reel spool and the flexible member relative to each other to vary the deflection of the flexible member. A controller is connected to the deflection sensor and the actuator for controlling the amount of deflection of the flexible member as the roll increases in diameter. A reel-up of similar type has also been disclosed in, for example, U.S. Pat. No. 6,698,681. This kind of reel-up has produced excellent results and is particularly suitable for tissue paper, i.e. such tissue products as bath tissue, paper towel, facial tissue and the like where the basis weight may be in the range of 12 g/m$^2$-35 g/m$^2$ although other numerical values are also conceivable. In many realistic cases, the basis weigh may be, for example, in the range of 16 g/m$^2$-26 g/m$^2$. Practical experience from such reel-ups has demonstrated that excellent results can be obtained. One advantage that has been obtained is that there is an improved uniformity in sheet properties of paper webs unwound from the parent roll. For a detailed discussion of the advantages of such reel-ups, reference is made to U.S. Pat. Nos. 5,901,918 and 6,698,681.

The object of the present invention is to improve the operation of such reel-ups. One desirable improvement is to increase the reliability of the threading function and in particular rethreading when a web break has occurred. The objects of the invention are achieved by the present invention as will be explained in the following.

BRIEF SUMMARY

The invention relates to a method of threading a fibrous web onto a circular cylindrical object in a reel-up for a paper-making machine such that the fibrous web can be wound onto the circular cylindrical object. The reel-up comprises an endless flexible belt mounted for rotation along a predetermined path of travel. The fibrous web resides on, i.e. travels on, the outside surface during winding and is positioned adjacent the circular cylindrical object to engage the circular cylindrical object during winding such that the endless flexible belt is deflected from the predetermined path of travel by the fibrous web by an amount relative to the amount of fibrous web that is wound on the circular cylindrical object. When a fibrous web is to be threaded onto the circular cylindrical object, the circular cylindrical object is placed at a distance from the endless flexible belt such that the endless flexible belt is no longer deflected from its predetermined path of travel. A narrow tail is cut from a fibrous web that is to be threaded and the narrow tail is advanced on the outside surface of the endless flexible belt. An adhesive substance is applied either to the to the narrow tail or to the circular cylindrical object. The circular cylindrical object is moved towards the endless flexible belt such that the circular cylindrical object comes into contact with the narrow tail and the narrow tail starts to be wound on the circular cylindrical object whereafter the narrow tail is widened.

In advantageous embodiments of the invention, it may be so that, before the narrow tail onto which an adhesive may have been applied is advanced on the outside surface of the endless flexible belt, the circular cylindrical object is placed at as distance from the endless flexible belt is in the range of 20 mm-500 mm. Preferably, it is placed at a distance in the range of 30 mm-400 mm from the endless flexible belt and, even more preferred, at a distance from the endless flexible belt which is in the range of 40 mm-60 mm.

In embodiments of the invention, the circular cylindrical object may be a roll of paper that is wound on a reel spool. The threading is then an act of rethreading a fibrous web that is being wound onto a roll on the reel spool when a web break has occurred. The roll of paper will then initially be in contact with the endless flexible belt and subsequently moved away to a position at a distance from the endless flexible belt whereafter a narrow tail is cut and an adhesive is applied to the narrow tail.

In another embodiment, the circular cylindrical object is a reel spool and the threading is an act of threading a web directly onto the reel spool.

The invention also relates to a reel-up for carrying out the inventive method. The reel-up comprises an endless flexible belt mounted for rotation along a predetermined path of travel and a plurality of guide rolls supporting the endless flexible belt. The inventive reel-up also comprises at least one carriage for supporting a reel spool and at least one actuator which is capable of moving the at least one carriage and it also comprises at least one adhesive applicator arranged to apply an adhesive onto a narrow tail of a fibrous web or to a circular cylindrical object and also at least one cutting device capable of cutting a narrow tail from a fibrous web. Furthermore, the inventive reel-up comprises a logic control unit that is capable of controlling the operation of the at least one actuator, the at least one adhesive applicator and the at least one cutting device. The logic control unit comprises software with instructions to carry out the inventive method.

DETAILED DESCRIPTION OF VARIOUS EMBODIMENTS

Figure 1:
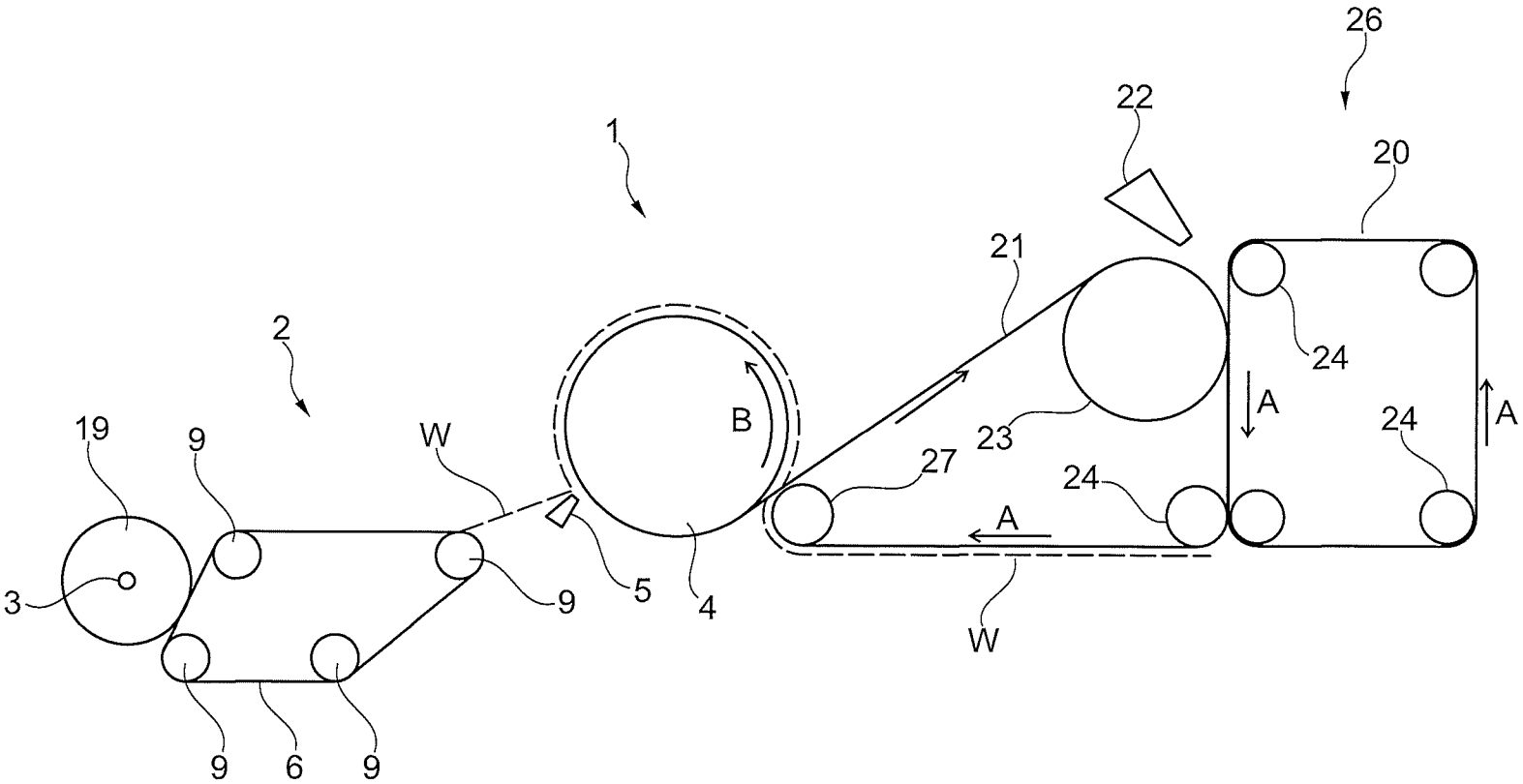
FIG. 1 is a schematic side view of a paper making machine which comprises a reel-up of the kind for which the inventive method is intended.

With reference to FIG. 1, the inventive method can be used in a reel-up 2 which is a part of a paper making machine 1. The paper making machine 1 normally comprises a forming section 26 where a fibrous web W is formed. The forming section 26 typically comprises a head box 22, a first forming fabric 20 and a second forming fabric 21. Each forming fabric 20, 21 may be arranged to run in a loop supported by guide rolls 24 and a forming roll 23. The arrows A in FIG. 1 indicate the direction of movement of the forming fabrics 20, 21. The head box 22 is arranged to inject stock in an inlet gap between the forming fabrics 20, 21. The head box may be, for example, such a head box as disclosed in U.S. Pat. No. 6,030,500 but other head boxes may also be used. The forming fabrics 20, 21 may be forming wires but the forming fabric 21 may optionally be a water-absorbing felt. From the forming section 26, the newly formed fibrous web W may be transferred to a drying section which comprises one or several drying cylinders. In the embodiment of FIG. 1, the drying section comprises one single drying cylinder which may be a Yankee drying cylinder 4 which is arranged to be capable of rotation in the direction of arrow B. The fibrous web W may conceivably be transferred to the Yankee drying cylinder in a transfer nip or press nip formed between the Yankee drying cylinder 4 and a press roll 27 inside the loop of the second forming fabric 21. The Yankee drying cylinder 4 may conceivably be, for example, such a Yankee drying cylinder as disclosed in U.S. Pat. No. 8,438,752 or 4,320,582 but it may be designed in many other ways. The Yankee drying cylinder 4 is normally heated from the inside by hot steam but other methods of heating a drying cylinder may conceivable be used. On the Yankee drying cylinder 4, the fibrous web W is dried which means that water in the fibrous web W is evaporated by heat. A doctor 5 may be arranged to crepe the dried fibrous web W from the surface of the Yankee drying cylinder 4. The doctor 5 may conceivably be designed according to, for example, U.S. Pat. No. 5,507,917 but many other kinds of doctors may be used.

After the fibrous web W has been taken from the Yankee drying cylinder 4, it will be passed on for further processing which includes reeling, i.e. a process where the fibrous web is wound onto a reel spool in a reel-up.

It should be understood that the general design of the paper machine 1 that is shown in FIG. 1 is only schematic. The general design of the forming section and the drying section does not form a part of the present invention and is shown only as an example. The present invention may thus be used in paper making machines where the forming section 26 and the drying section is designed in many other different ways.

Figure 2:
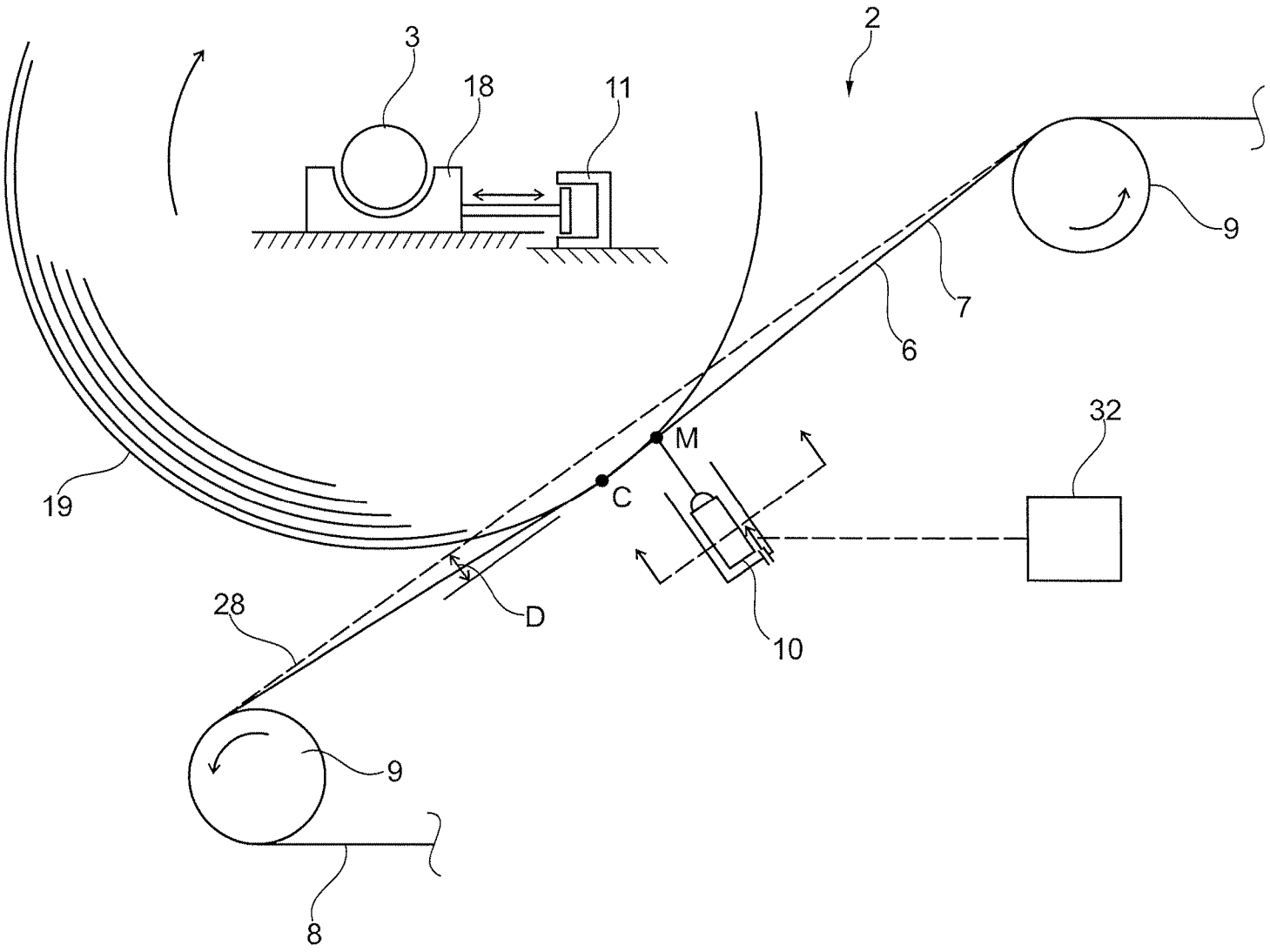
FIG. 2 is a view similar to FIG. 1 but showing parts of the reel-up in greater detail.

As can be seen in FIG. 1, the fibrous web W is passed from the Yankee drying cylinder 4 to a reel-up 2. The reel-up 2 may in particular be a reel-up which is designed substantially as disclosed in U.S. Pat. No. 5,901,918. For a detailed understanding of how such a reel-up functions, reference is made to U.S. Pat. No. 5,901,918. A substantially similar reel-up is disclosed also in U.S. Pat. No. 6,698,681. A brief explanation of how such a reel-up 2 may function will now be given with reference to FIG. 2. The fibrous web W is carried on the outside surface 8 of an endless flexible belt 6 which is mounted for rotation along a predetermined path of travel supported by support rolls 9 and the fibrous web W is wound on a reel spool 3 to a roll of paper 19. The support rolls 9 are normally placed inside the loop of the endless flexible belt 6 and contact the inside surface 7 of the endless flexible belt 6 but one or several support rolls 9 may also be placed to contact the outer surface 8 of the endless flexible belt 6. The reel spool 3 is supported in a carriage 18 that can be moved by an actuator 11. It should be understood that there may be more than one carriage 18 and that there may be one carriage for each axial end of the reel spool 3. The paper roll 19 engages the endless flexible belt 6 such that the endless flexible belt is deflected from its predetermined path of travel 28 by the paper roll 19. In FIG. 2, the deflection of the endless flexible belt 6 is indicated as "D". In FIG. 2, the greatest deflection D is reached at the nip point C. One or several measurement devices 10, for example one or several laser sensors are arranged to measure the deflection D of the endless flexible belt 6. The deflection D may be measured at the nip point C but it may also be measured at a point M where the deflection D is somewhat smaller. The position of the reel spool 3 can be adjusted based on the measured value for the deflection D. To keep the nip force between the paper roll 19 and the endless flexible belt 6 within predetermined levels, the deflection D should be kept within certain limits. If the measured value for the deflection D is too high, a signal is sent to cause the actuator 11 to move the carriage 18 away from the endless flexible belt 6 such that the deflection D becomes smaller. In the same way, the actuator 11 can be caused to move the carriage 18 towards the endless flexible belt 6 such that the deflection D increases. For a more detailed explanation, reference is made to U.S. Pat. No. 5,901,918.

The measurement device(s) 10 are suitably connected to a logic control unit 32 such that the measurement device(s) can communicate with the logic control unit 32 and give signals to the logic control unit 32 that indicate a value for the deflection D of the endless flexible belt 6. The logic control unit 32 is suitably also in connection with the actuator or actuators 11 and suitably comprises software to control the actuator or actuators 11 to move the carriage(s) 18 in order to keep the deflection D within predetermined limits. The logic control unit may also be arranged to control other components. The logic control unit 32 may be a computer.

Figure 3:
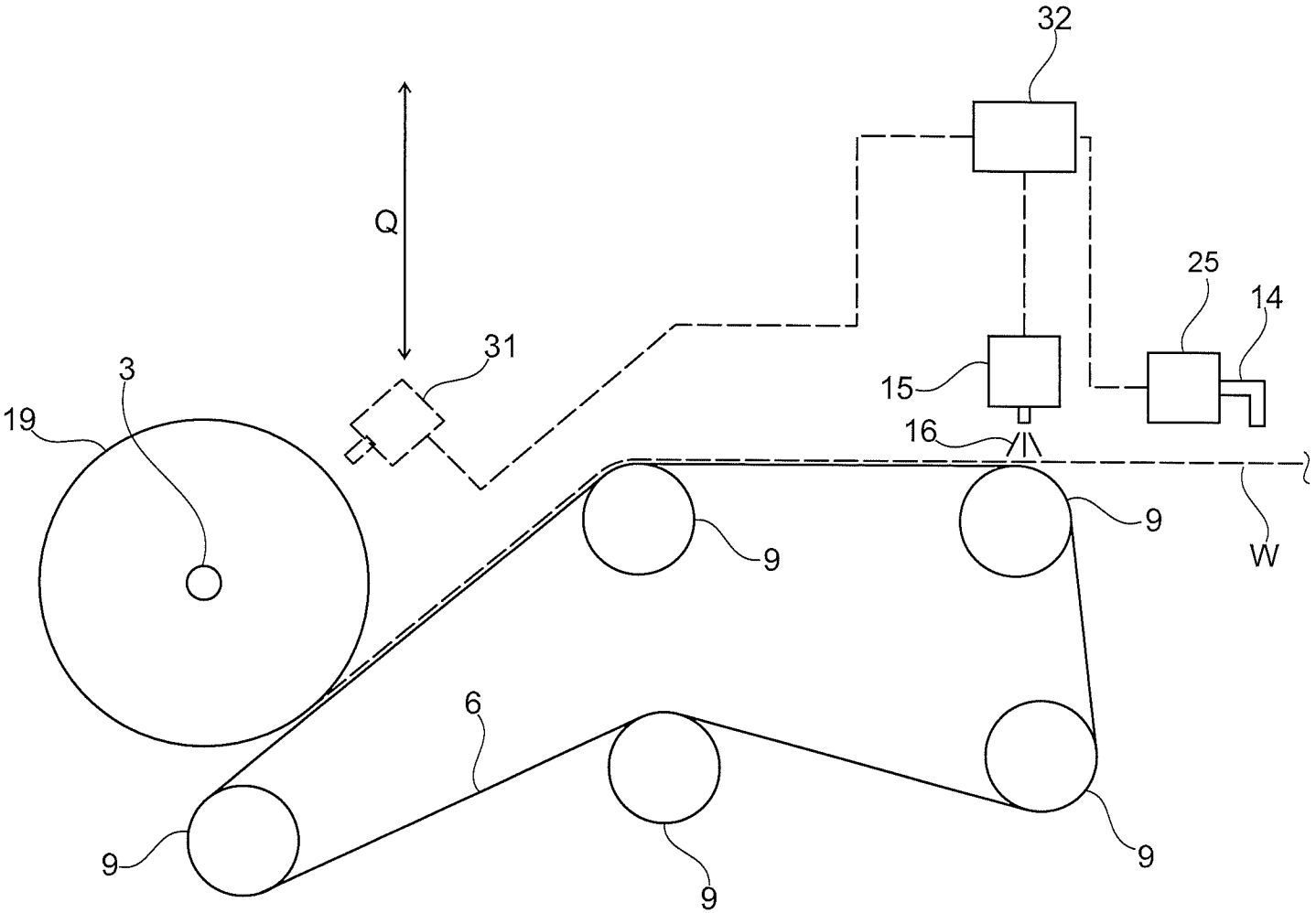
FIG. 3 shows a view which is similar to that of FIG. 2 and in which some further details are included.

Reference will now be made to FIG. 3. In order to cut a narrow tail from the fibrous web W for the purpose of performing a threading operation, one or several cutting devices 14 are placed in a position to act on the fibrous web W. The cutting device(s) may be carried by a support beam 25. An applicator 15 is arranged to be capable of applying (e.g. by spraying) an adhesive substance 16 onto the fibrous web W or to a narrow tail cut from the fibrous web W. The positions of the cutting device 14 and the adhesive applicator 15 is not necessarily as shown in FIG. 3 and various different positions are conceivable, the representation of FIG. 3 is thus only schematic or exemplary.

Instead of using an adhesive applicator 15 that is arranged to apply an adhesive onto the narrow tail 17, an adhesive applicator 31 may be used as indicated by broken lines in FIG. 3. The adhesive applicator 31 may operate to apply adhesive directly onto the paper roll 19 or an empty reel spool such that adherence between a narrow tail and the paper roll 19 or an empty reel spool 3 can be achieved. The adhesive applicator 31 may suitably be arranged to move towards or away from the paper roll 19 (or empty spool 3) as indicated by the arrow Q such that the adhesive applicator 31 can be placed at a suitable distance from the surface onto which an adhesive is to be applied (for example by spraying).

Figure 4:
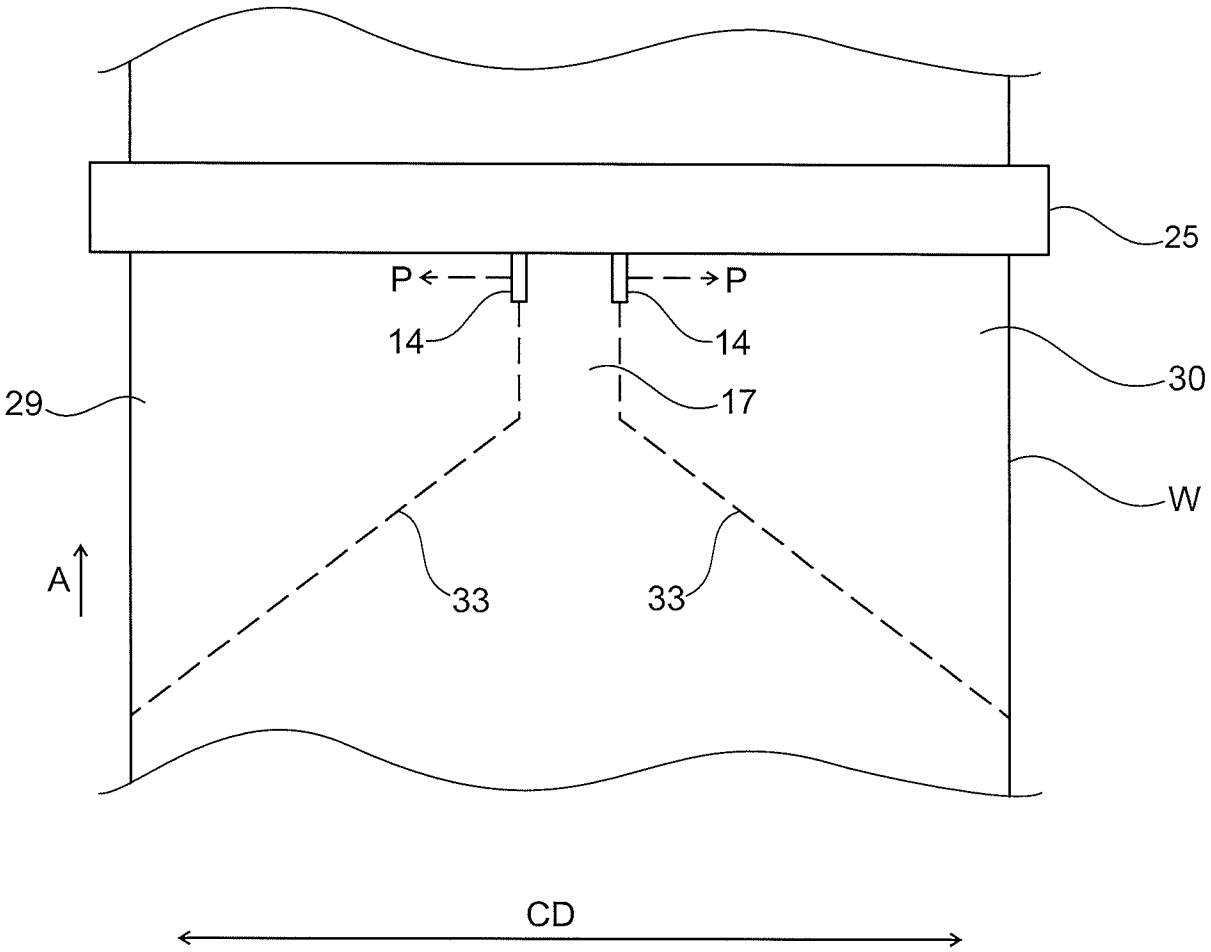
FIG. 4 is a view from above illustrating how a narrow tail may be cut from the fibrous web.

With further reference to FIG. 4, the cutting may be performed by two cutting devices 14 that may be water nozzles arranged to cut the fibrous web W by means of water jets, i.e. jets of pressurized water. An example of such an arrangement for cutting a narrow tail 17 is disclosed in, for example, U.S. Pat. No. 9,511,968 but the arrangement for cutting a narrow tail 17 may take many other forms as is known to the skilled person. In FIG. 4, the fibrous web W is moving in the direction of the arrow A. The cutting devices 14 are normally water jet nozzles but other cutting devices such as knives or laser beam cutters may conceivably be used. The cutting devices 14 are movably arranged on a support beam 25 such that they can be moved in the direction of arrows P in a direction perpendicular to the direction of movement A of the fibrous web W. When a narrow tail for threading is to be cut, the cutting devices 14 can be activated such that the fibrous web W is cut into a narrow tail 17 and two side parts 29, 30. The narrow tail 17 can subsequently be widened by moving the cutting devices 14 in the direction of arrows P such that the narrow tail 17 increases in width until it has reached the whole width of the fibrous web. In FIG. 4, the broken lines 33 indicate how the narrow tail 17 increases in width as the fibrous web W advances in the direction of arrow A and the cutting devices 14 move towards the edges of the fibrous web W in the direction of arrows P. When the narrow tail 17 has been cut, an adhesive 16 can be applied to the narrow tail 17 by the adhesive applicator 15 such that the narrow tail 17 can adhere to an empty reel spool 3 when a roll of paper 19 has been completed and the fibrous web W is to be threaded onto a new empty reel spool 3. This process as such is known to the skilled person.

It should be understood that the narrow tail 17 does not necessarily have to be start from the middle of the fibrous web W as indicated in FIG. 4. In alternative embodiments, the narrow tail 17 may start at one of the edges of the fibrous web W.

It should also be understood that adhesive is applied at a location in the cross machine direction (CD) of the fibrous web W that matches the position of the narrow tail in the cross machine direction such that adhesive is applied to the tail or to that part of the paper roll 19 (or empty reel spool 3) that will meet the narrow tail 17.

Figure 5:
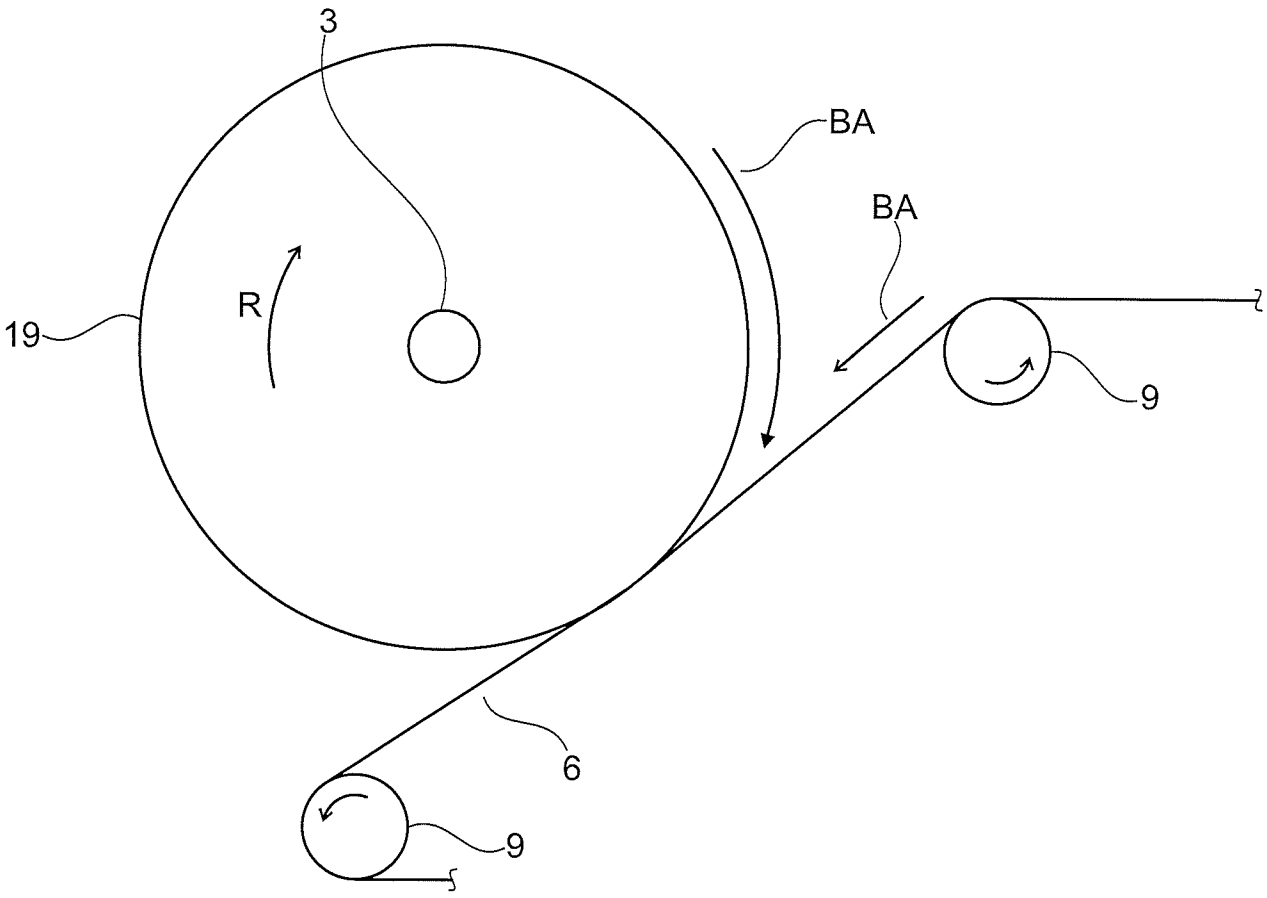
FIG. 5 is a view substantially similar to FIG. 2 but in which a technical problem is highlighted.

A technical problem will now be explained with reference to FIG. 5. When the reel-up 2 is operating, it may happen that the fibrous web W breaks before the paper roll 19 has reached its full diameter. In such a case, it is desirable that the web can be rethreaded such that winding can continue until the paper roll 19 has reached its full size/diameter.

Therefore, an attempt will often be made to perform rethreading directly onto the paper roll 19 instead of threading the fibrous web onto a completely new reel spool 3. However, the inventors have noted that rethreading becomes more and more difficult with increasing size of the paper roll 19. Without wishing to be bound by theory, the inventors believe that the reason for this is probably the following. The outer surface of the paper roll 19 which is rotating in the direction of arrow R will cause a boundary layer of air BA to be dragged along with it and into the gap between the paper roll 19 and the endless flexible belt 6. Boundary layer air BA will also be dragged by the endless flexible belt 6 or by fibrous web W on the surface of the endless flexible belt 6. This boundary layer air will also be directed into the gap between the endless flexible belt 6 and the paper roll 19. The boundary layer air BA will thus result in air streams directly into the gap between the endless flexible belt 6 and the paper roll 19. As the air streams get larger, they will also tend to become more turbulent and if a narrow tail 17 is sent towards the paper roll 19 for rethreading, turbulent air streams will cause the narrow tail 17 to flutter which makes rethreading more difficult. The reason that the problem becomes more serious as the diameter of the paper roll 19 increases is probably that a paper roll with a large diameter will drag more air with it than a paper roll 19 with a smaller diameter. The inventors have noted that there may, in some cases, be tendencies to such problems even when threading is to be performed only on an empty reel spool 3 but the problem is then normally much smaller and can often be disregarded. However, with increasing machine speeds, there may be reasons to fear that air streams will lead to difficulties even in connection with threading onto an empty reel spool 3.

The invention can be described in general terms as a method of threading in which a fibrous web W is threaded onto a circular cylindrical object that may be a paper roll 19 that is wound on a reel spool 3 but which may also be simply an empty reel spool 3. In the context of this patent application and any patent that is issued based on this patent application, the term "threading" shall be understood as including both threading on an empty reel spool 3 and rethreading on a paper roll after a web break.

Figure 6:
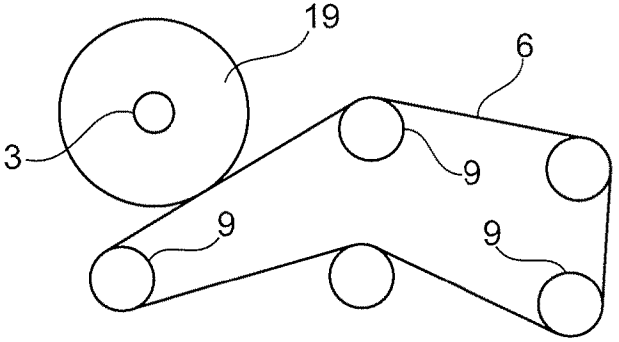
FIG. 6 is a side view showing the initial situation after a web break has occurred.
Figure 7:
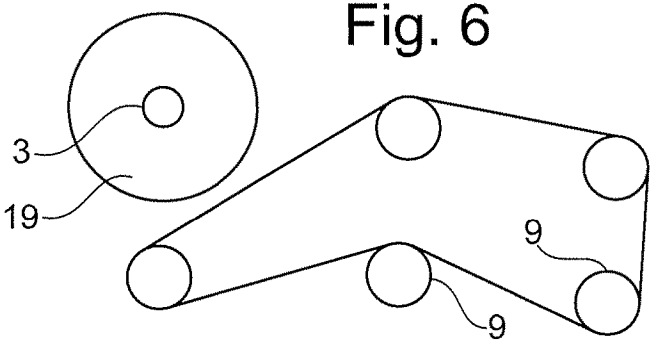
FIG. 7 is a side view showing a part of the procedure for performing rethreading on a paper roll.

The invention will now be explained with reference to FIG. 6-FIG. 11 that show a first embodiment that relates to rethreading on a paper roll 19. In FIG. 6, a situation is shown in which a paper roll 19 has started to form but has not yet reached its full diameter and a web break has occurred such that the fibrous web W is no longer being wound onto the paper roll 19. The paper roll 19 is in contact with the endless flexible belt 6, either directly or possibly through such fibrous web W that is no longer being wound onto the paper roll 19. The next step in the inventive method is shown in FIG. 7. In FIG. 7, it can be seen how the reel spool 3 and thereby also the paper roll 19 has been moved away from the endless flexible belt 6 such that there is a gap between the outer surface of the paper roll 19 and the endless flexible belt 6. With reference to FIG. 11, it can be seen more clearly how there is a shortest distance T between the outer surface of the paper roll 19 and the endless flexible belt 6 that is now not deflected by the paper roll 19 from its predetermined path of travel. Even a small distance T will be helpful for rethreading since boundary layer air can now pass between the paper roll 19 and the endless flexible belt 6 and will not be forced to the sides so much. However, the inventors have found that it is advantageous if the distance T has a certain smallest value. Preferably, the distance T should be at least 20 mm. If the distance T is very large, this will of course reduce the risk even further but it is desirable that the movement of the paper roll 19 is kept small since unnecessarily large movements are a waste of time. For this reason, the distance should preferably not be made larger than 500 mm. The distance T may therefore be in the range of 20 mm-500 mm but other distances are also conceivable, both less than 20 mm and larger than 500 mm. In many cases, it is desirable to use a distance of at least 30 mm while a distance T larger than 400 mm would be seen as unpractical. The distance T may therefore be in the range of 30 mm-400 mm. The inventors have found that, for many practical applications, the distance T may be in the range of 40 mm-80 mm or 40 mm-60 mm which is believed to be the most preferred range.

It should be understood that the reel spool 3 and the paper roll 19 may suitable be moved away from the endless flexible belt by means of the actuator or actuators 11 shown in FIG. 2 but the reel spool 3 could conceivably also be lifted by a separate lifting device (not shown).

With the reel spool 3 and the paper roll 19 in the position shown in FIG. 7 and FIG. 11, the air streams will no longer cause any significant fluttering of a narrow tail 17 that is advanced for threading and the rethreading can now be performed with less difficulty.

Figure 8:
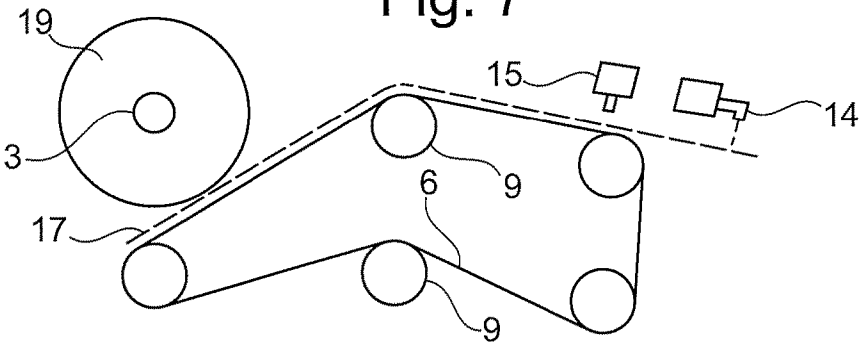
FIG. 8 is a side view similar to FIG. 7 but showing another part of the rethreading procedure.

With reference to FIG. 8, the cutting device 14 can now be activated such that a narrow tail 17 is cut and sent forward. FIG. 8 shows how the narrow tail 17 travels on the endless flexible belt 6 and past the paper roll 19. The narrow tail 17 does not contact the paper roll 19 since there is a distance T between the paper roll 19 and the endless flexible belt 6 on which the narrow tail 17 is traveling.

Figure 9:
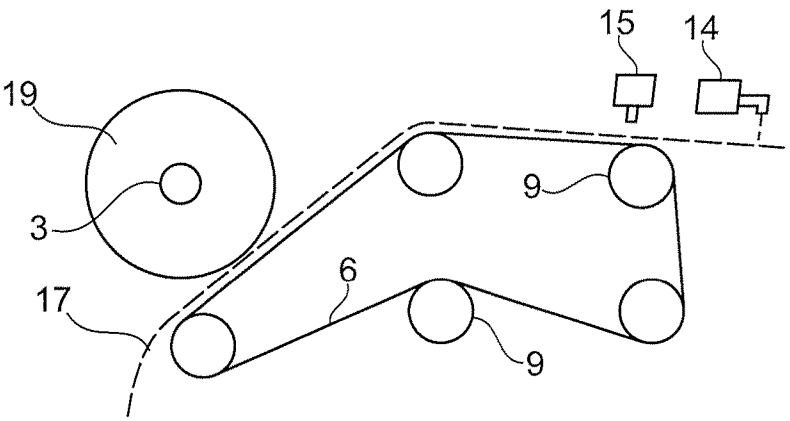
FIG. 9 is a side view similar to FIG. 7 and FIG. 8 but showing yet another part of the rethreading procedure.

A following step may be seen in FIG. 9. As can be seen in FIG. 9, the paper roll 19 has now moved back to contact the narrow tail 17 that travels on the endless flexible belt 6. Preferably, it has been moved back to the same or substantially the same position that it was in when the web break occurred and the deflection D of the endless flexible belt 6 will then be the same as it was when the web break occurred. However, it could also be in a slightly different position such that the deflection D is somewhat larger or somewhat smaller than it was when the web break occurred. FIG. 9 shows a situation in which no adhesive has yet been applied to the narrow tail 17 and the narrow tail 17 is not wound onto the paper roll 19.

Figure 10:
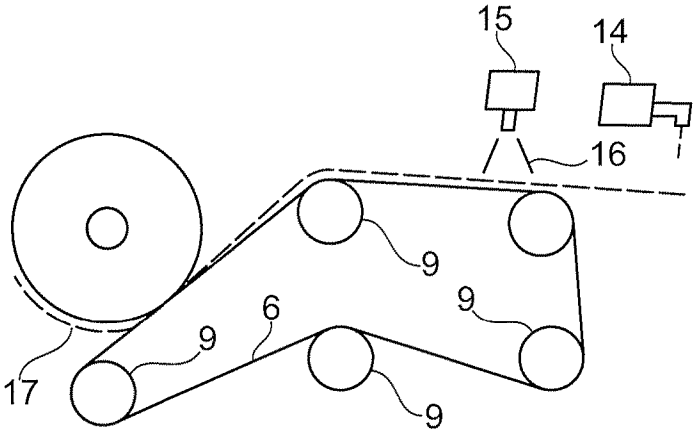
FIG. 10 is a side view similar to FIGS. 7-9 but showing yet another part of the rethreading procedure.
Figure 11:
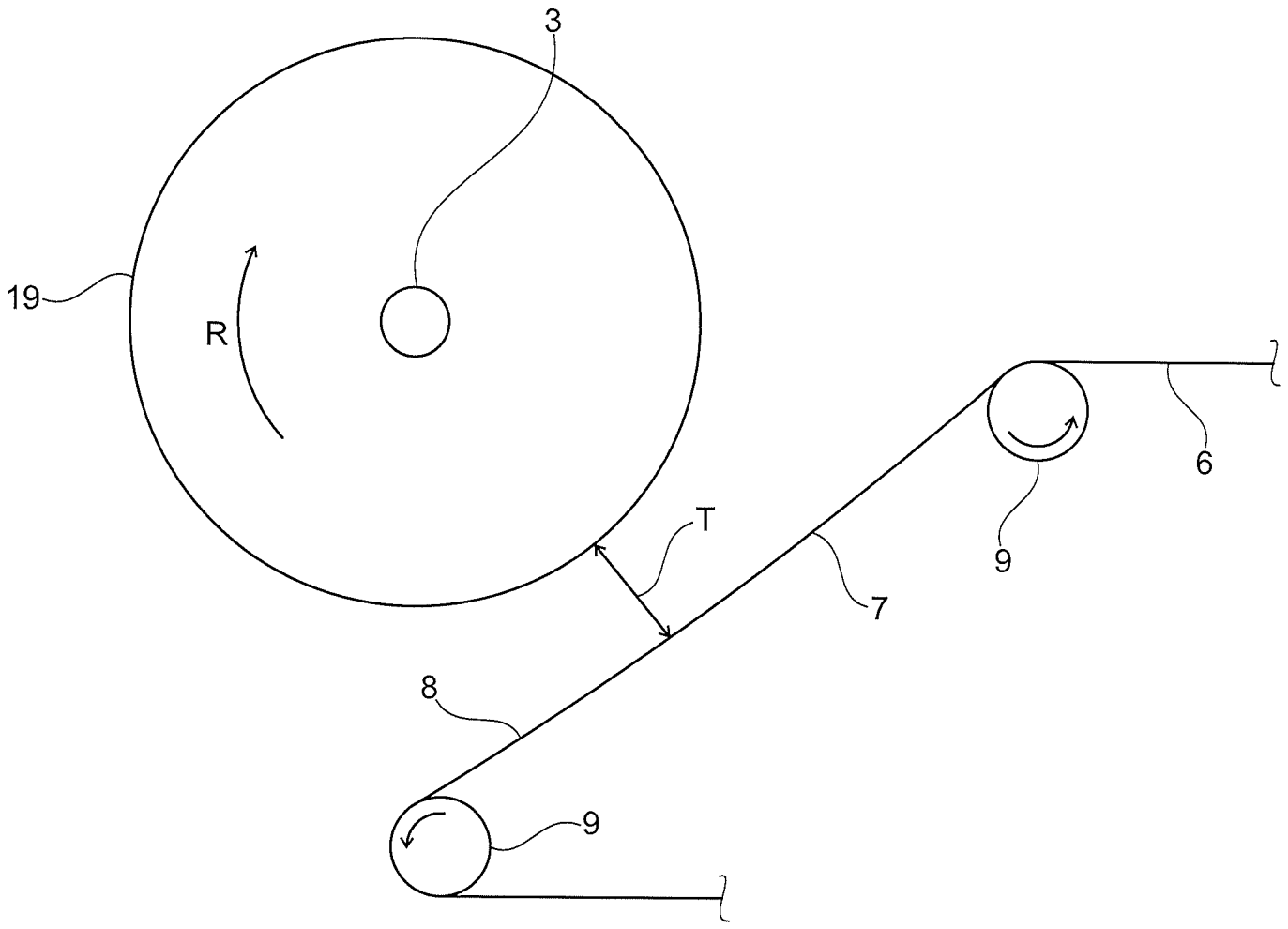
FIG. 11 is a view similar to FIG. 7 in which one aspect has been shown more clearly.

Reference is now made to FIG. 10. In FIG. 10, it can be seen how the adhesive applicator 15 is activated to eject an adhesive 16 onto the narrow tail 17. When a part of the narrow tail 17 onto which adhesive has been applied reaches the paper roll 19, the narrow tail 17 will start to get wound onto the paper roll 19 as can be seen in FIG. 10. The narrow tail can then be widened to include the full width of the fibrous web W. The winding/reeling operation can then continue until the paper roll 19 reaches its final diameter. At this stage, a new (empty) reel spool 3 will be brought forward and winding can start on the new reel spool.

Here, it should be understood that, instead of using the adhesive applicator 15 and apply an adhesive to the narrow tail 17, the adhesive applicator 31 can be used to apply an adhesive directly onto the paper roll 19. When the narrow tail 17 reaches the paper roll 19, it will then adhere to the paper roll 19 and start to get wound on the paper roll 19.

It should be understood that FIGS. 6-11 are intended for illustrative purposes to give an easy understanding of the process and that the actual procedure may be slightly different. For example, it is possible that adhesive is applied at the same time as the narrow tail 17 has been cut such that the narrow tail 17 starts to get wound on the paper roll as soon as it reaches the roll. It should also be understood that the movement of the paper roll 19 back towards the endless flexible belt 6 may conceivably be synchronized with the tail cutting and the application of an adhesive. The cutting of the narrow tail 17 may also be synchronized with the movement of the paper roll 19 away from the endless flexible belt. Unless explicitly stated in the claims, it should not be assumed that the various steps of the inventive method necessarily take place in any particular order, even if one method step is mentioned after another method step. However, embodiments of the invention are possible in which the method steps take place in the order illustrated in FIG. 6-FIG. 11. Embodiments are thus possible in which the paper roll 19 is first moved away from the endless flexible belt and the narrow tail is cut thereafter. Following cutting of the narrow tail 17, the narrow tail 17 may be caused to pass the paper roll 19 without contacting it. Subsequently paper roll 19 is moved to contact the narrow tail 17 and the adhesive is applied only after the paper roll 19 has contacted the narrow tail. However, other procedures can be followed. For example, the steps of moving the paper roll 19 away from the endless flexible belt and cutting the narrow tail 17 may be performed in sequence while the adhesive is applied at the same time as the paper roll 19 starts to move back towards the endless flexible belt. The paper roll 19 may be moved into contact with the narrow tail 17 before an adhesive is applied to the narrow tail 17 or to the paper roll 19. Alternatively, an adhesive may be applied to the narrow tail 17 or the paper roll even before the paper roll 19 is moved into contact with the narrow tail 17.

It should be understood that, while the cutting device(s) 14 are not shown in FIGS. 6-11, they are still there. The same applies to the glue applicator 15 or 31.

Figure 12:
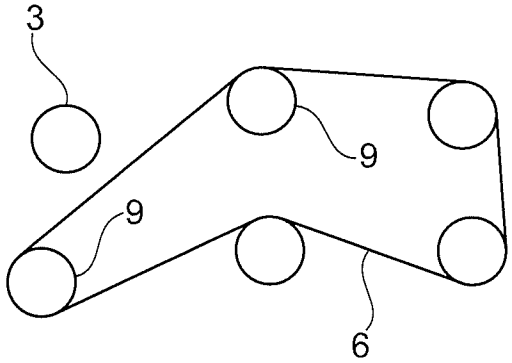
FIG. 12 is a view similar to FIG. 7 but showing a part of the procedure for threading on an empty reel spool.
Figure 13:
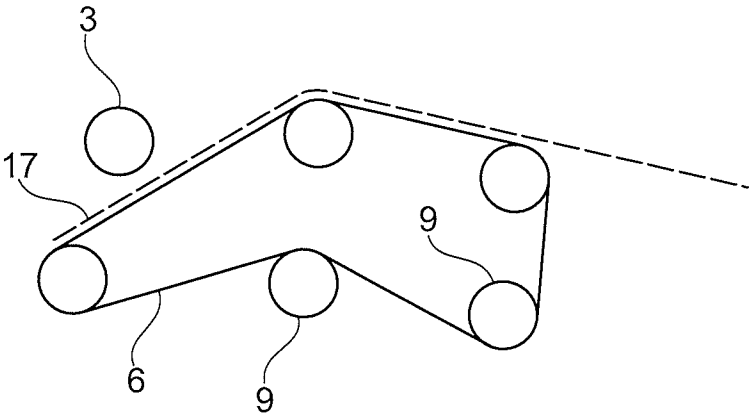
FIG. 13 is a view similar to FIG. 8 but showing a part of the procedure for threading on an empty reel spool.
Figure 14:
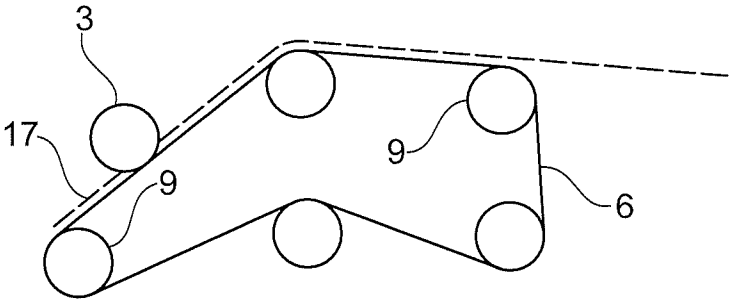
FIG. 14 is a view similar to FIG. 9 but showing a part of the procedure for threading on an empty reel spool.
Figure 15:
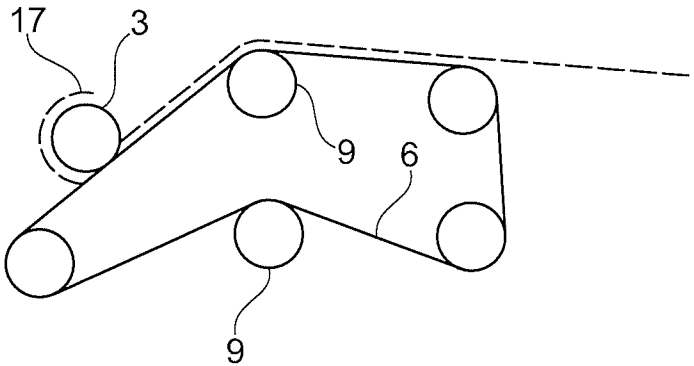
FIG. 15 is a view similar to FIG. 10 but showing a part of the procedure for threading on an empty reel spool.

Reference will now be made to FIG. 12-FIG. 15. These figures illustrate how the inventive method may be used for threading on an empty reel spool 3. With reference to FIG. 12, the empty reel spool 3 may optionally already in the beginning of the threading operation be placed in a position away from the endless flexible belt 6, i.e. at a distance from the endless flexible belt 6. FIG. 13 shows how a narrow tail 17 has been cut and has been advanced on the endless flexible belt 6 beyond the point where engagement with the reel spool 3 is intended to take place. In FIG. 14, it can be seen how the empty reel spool 3 has been brought into contact with the narrow tail 17 but the narrow tail 17 does not adhere to the empty reel spool 3 since no adhesive has yet been applied to the empty reel spool 3. With reference to FIG. 15, an adhesive has now been applied to the narrow tail 17 and the narrow tail 17 has started to be wound on the reel spool 3 and thus begun to form a paper roll 19. The narrow tail can then be widened to include the full width of the fibrous web W.

It should be understood that, while the cutting device(s) 14 are not shown in FIGS. 12-15, they are still there. The same applies to the glue applicator 15 or 31.

When threading is to be performed on an empty reel spool 3, the distance T (see FIG. 11) can be somewhat smaller than when rethreading on a paper roll 19 is to be performed. For example, it may be in the range of 7 mm-80 mm or in the range of 10 mm-30 mm.

The inventive method may suitably be carried out in connection with winding of a tissue paper web, i.e. such tissue webs that are intended for bath tissue, paper towel, facial tissue and the like where the basis weight may be in the range of 12 $g/m^2$-35 $g/m^2$ although other numerical values are also conceivable. In many realistic cases, the basis weight may be, for example, in the range of 16 $g/m^2$-26 $g/m^2$. However, the invention may be used also for grades with both a higher and a lower basis weight.

The inventive method may thus be understood generally as a method in which threading is performed on a circular cylindrical object which may be an empty reel spool 3 or which may be a paper roll 19 having a substantial diameter.

The invention may also be understood in terms of a reel-up that comprises the endless flexible belt 6; the guide rolls 9; the actuator(s) 11; the carriage 18; at least one adhesive applicator 15, 31; at least one cutting device 14 and which reel-up also comprises a logic control unit 32 that is capable of controlling the operation of the actuator(s) 11, the at least one adhesive applicator 15, 31 and the at least one cutting device 14. The logic control unit 32 comprises software with instructions to carry out the inventive method. Suitably, the same logic control unit may be used for controlling the deflection D of the endless flexible belt 6.

It should be understood that the inventive reel-up may also include the measurement device(s) 10 although the reel-up may be sold and delivered without such a measurement device 10.

Thanks to the invention, the advantage is obtained that a narrow tail can be threaded onto a paper roll 19 or a reel spool 3 with less difficulty than if the method is not used. The method is particularly useful for performing rethreading onto a paper roll 19 which is probably because a paper roll will generate more disturbance from air flows.

While the invention has been described above in terms of a method and a reel-up, it should be understood that these categories only reflect different aspects of one and the same invention.

The invention claimed is:

1. A method of threading a fibrous web (W) onto a circular cylindrical object (3, 19) in a reel-up (2) for a paper-making machine (1) such that the fibrous web (W) can be wound onto the circular cylindrical object (3, 19), wherein the reel-up (2) comprises an endless flexible belt (6) mounted for rotation along a predetermined path of travel and having an inside surface (7) and an outside surface (8), the endless flexible belt (6) being positioned adjacent the circular cylindrical object (3, 19) during winding and the fibrous web (W) residing on the outside surface (8) to engage the circular cylindrical object (3, 19) during winding such that the endless flexible belt (6) is deflected from the predetermined path of travel by the fibrous web (W) by an amount relative to the amount of fibrous web (W) that is wound on the circular cylindrical object (3, 19), the method comprising the steps of:

when a fibrous web (W) is to be threaded onto the circular cylindrical object (3, 19), positioning the circular cylindrical object (3, 19) at a distance (T) from the endless flexible belt (6) such that the endless flexible belt (6) is no longer deflected from its predetermined path of travel;

cutting a narrow tail (17) from the fibrous web (W) that is to be threaded and advancing the narrow tail (17) on the outside surface (8) of the endless flexible belt (6);

moving the circular cylindrical object (3, 19) towards the endless flexible belt (6) such that the circular cylindrical object (3, 19) comes into contact with the narrow tail (17); and applying an adhesive substance either to the narrow tail (17) or to the circular cylindrical object (3, 19) such that the narrow tail (17) will adhere to the circular cylindrical object and start to be wound on the circular cylindrical object (3, 19), whereafter the narrow tail (17) is widened.

2. A method according to claim 1, wherein, before the narrow tail is advanced on the outside surface of the endless flexible belt (6), the circular cylindrical object (3, 19) is placed at a distance (T) from the endless flexible belt (6) which is in the range of 20 mm-500 mm.

3. A method according to claim 1, wherein, before the narrow tail is advanced on the outside surface of the endless flexible belt (6), the circular cylindrical object (3, 19) is placed at a distance (T) from the endless flexible belt (6) which is in the range of 30 mm-400 mm.

4. A method according to claim 1, wherein, before the narrow tail is advanced on the outside surface of the endless flexible belt (6), the circular cylindrical object (3, 19) is placed at a distance (T) from the endless flexible belt (6) which is in the range of 40 mm-60 mm.

5. A method according to claim 1, wherein:

the circular cylindrical object is a roll of paper (19) that is wound on a reel spool (3);

the threading is an act of rethreading a fibrous web (W) that is being wound onto a roll (19) on the reel spool (3) when a web break has occurred; and the roll of paper (19) is initially in contact with the endless flexible belt (6) and then moved away to a position at a distance from the endless flexible belt (6), whereafter the narrow tail (17) is cut and the adhesive is applied to the narrow tail (17).

6. A method according to claim 1, wherein:

the circular cylindrical object is a reel spool (3); and the threading is an act of threading a web (W) directly onto the reel spool (3).

7. A method according to claim 6, wherein the reel spool (3) is placed at a distance (T) from the endless flexible belt (6) which is in the range of 7 mm-80 mm.

8. A method according to claim 6, wherein the reel spool (3) is placed at a distance (T) from the endless flexible belt (6) which is in the range of 10 mm-30 mm.

9. A method according to claim 1, wherein the circular cylindrical object (3, 19) is moved into contact with the narrow tail (17) before the adhesive substance is applied to the narrow tail (17) or to the circular cylindrical object.

10. A method according to claim 1, wherein the adhesive substance is applied to the narrow tail (17) or the circular cylindrical object (3, 19) before the circular cylindrical object (3, 19) is moved into contact with the narrow tail (17).

11. A reel-up (2) comprising:

an endless flexible belt (6) mounted for rotation along a predetermined path of travel;

a plurality of guide rolls (9) supporting the endless flexible belt (6);

at least one carriage (18) for supporting a reel spool (3);

at least one actuator (11) configured for moving the at least one carriage (18);

at least one adhesive applicator (15, 31) configured to apply an adhesive onto a narrow tail (17) of a fibrous web (W) or to a circular cylindrical object (3, 19);

at least one cutting device (14) configured for cutting a narrow tail from a fibrous web (W); and a logic control unit (32) configured for controlling the operation of the at least one actuator (11), the at least one adhesive applicator (15, 31) and the at least one cutting device (14), wherein the logic control unit (32) comprises software with instructions configured to carry out the method according to claim 1.

12. A method according to claim 1, wherein the threading is an act of rethreading a fibrous web (W) that is being wound onto a roll (19) on the reel spool (3) when a web break has occurred.

13. A method according to claim 12, wherein the roll of paper (19) is initially in contact with the endless flexible belt (6) and then moved away to a position at a distance from the endless flexible belt (6), whereafter the narrow tail (17) is cut and the adhesive is applied to the narrow tail (17).

* * * * *